United States Patent [19]

Krogsrud

[11] Patent Number: 4,526,224

[45] Date of Patent: Jul. 2, 1985

[54] MEANS FOR COOLING A BODY

[75] Inventor: Harald Krogsrud, Gjettum, Norway

[73] Assignee: Elkem A/S, Oslo, Norway

[21] Appl. No.: 217,688

[22] Filed: Mar. 18, 1982

[51] Int. Cl.[3] ..... F28B 1/00; F25B 41/06; B60H 1/00; B61D 27/00

[52] U.S. Cl. ..... 165/1; 165/40; 165/110; 165/DIG. 10; 165/DIG. 14; 62/527; 62/528

[58] Field of Search ..... 165/11, 14, 47, DIG.10, 165/133, DIG.14, 1, 40, 110; 62/315, 316, 527, 528

[56] References Cited

U.S. PATENT DOCUMENTS

| | | | |
|---|---|---|---|
| 2,182,788 | 12/1939 | Cornell, Jr. | 62/315 |
| 2,702,460 | 2/1965 | Gaugler | 62/527 |
| 3,693,367 | 9/1972 | Di Peri | 62/527 |
| 4,006,604 | 2/1977 | Seff | 165/46 |
| 4,325,151 | 4/1982 | Wu | 165/46 |

*Primary Examiner*—William R. Cline
*Assistant Examiner*—John K. Ford
*Attorney, Agent, or Firm*—Lucas & Just

[57] ABSTRACT

The publication relates to means for cooling a body, comprising at least a tube through which a liquid coolant is flowing in order to remove heat away from the at least one tube and its surroundings. The tube(s) houses an internally arranged hose having a wall thickness, permeability and/or porousity and a quality which corresponds to the heat energy to be removed from the tube(s) and/or it surroundings. The hose has preferably an outer diameter which corresponds substantially to the internal diameter of the tube(s) and the hose is formed of a texture of a flexible material such as for example textile or fiberglass. The hose may be fastened to the tube at its inlet end.

2 Claims, 3 Drawing Figures

MEANS FOR COOLING A BODY

BACKGROUND OF THE INVENTION

The present invention relates to means for cooling bodies which are exposed to high temperatures. In particular, the present invention relates to means for cooling and transfer of energy in the form of heat away from a body by means of a fluid, such as for instance water. The invention is preferably, but not exclusively, related to a cooling system in which the coolant is permitted to be present simultaneously both in liquid and vapour form.

In the following present invention will be described and discussed in conjunction with means for cooling structural members of and equipment on furnaces for smelting ferro alloys, pig iron and/or carbide. It should be appreciated, however, that the present invention is not limited to such use, but may in general be used wherever the possibility of the appearance of a two-phase condition in the coolant may occur due to excessive heating.

The traditional furnaces for production of ferro alloys, pig iron and carbide require means for cooling those structural members and the equipment which are arranged on or in function on or close to the furnace(s). Cooling of and transfer of energy away from said members or equipment is commonly achieved by means of a liquid coolant, such as for instance water. In recent years, a cooling system is introduced, permitting from a constructional point of view as high external temperature of the members as possible. Instead of depending on the conventional welded, double walled roof structures, relatively thick steel plates with steel pipes for circulating a coolant, the steel pipe(s) being welded on the external side of the roof, is now used. The internal surface temperature of the steel plates in such a structure will be in the order of 150°-400° C. This temperature range is well above the condensation point of water and also well above the condensation point of sulphurous acid, whereby the possibility of corrosion attack due to corrosive moisture is substantially reduced.

A cooling system incorporating steel tubes welded to the roof incorporates, however, certain limitations since the cooling water has a boiling point at 100° C., at atmospheric pressure i.e. well below the internal surface temperature of said steel plates. If the temperature of the body increases so much that the cooling water boils locally the produced steam will block the passage of cooling water through the tube, whereby the possibilities of controlling the temperature is lost. In order to remedy such a undesirable effect it has previously been proposed to use a coolant with a higher boiling point or to apply a high pressure coolant in the system, for example water exposed to high pressure. However, both these remedies incorporate certain vital disadvantages.

If the cooling system is based on a coolant with boiling point higher than 100° C., a heat exchanger must be used in order to reduce the temperature of the coolant before recycling. If on the other hand a high pressure cooling system is used, specific certificates for use and maintenance from the authorities are required, such authorization being dependent upon rigid safety and design requirements. For both systems apply that even small leakage will make the system unsuitable.

SUMMARY OF THE INVENTION

The object of the present invention is to solve the above and other problems related to cooling of a body and to increase the range of temperature control for the body to be cooled without having to change the cooling medium, its pressure, composition and/or character. Accordingly, the temperature within the system may thereby vary over an extended range without the occurence of overheating the system.

BRIEF DESCRIPTION OF THE DRAWINGS

The features and advantages of the cooling apparatus in accordance with the invention will be seen in the description of the figures wherein.

DESCRIPTION OF THE PREFERRED EMBODIMENT

Figure 1:
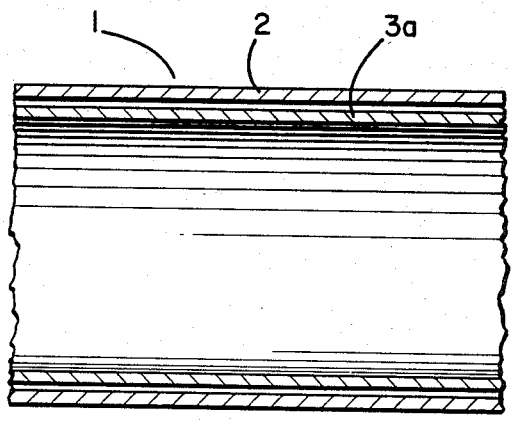
FIG. 1 is a longitudinal section of an embodiment of the invention.
Figure 2:
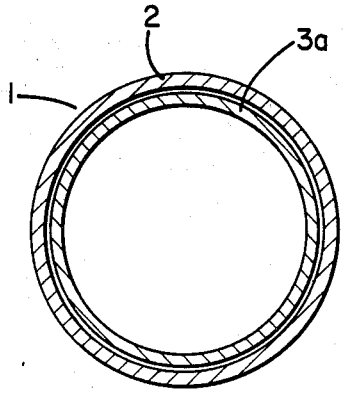
FIG. 2 is a transverse section of the embodiment of FIG. 1.
Figure 3:
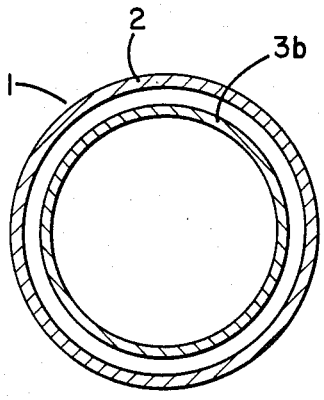
FIG. 3 is a transverse section showing a smaller diameter hose.

As seen in FIGS. 1–3 invention (shown generally at 1) comprises the introduction of a hose (3*a* or 3*b*) or flexible tube of textile material or filament or fibrous material such as for example fiberglas into the interior of one or more of the steel tubes (2) of the cooling system. Such a hose will be pliable or flexible and compliant. Thus, when subjected to an internal water pressure the hose will behave in an elastic manner. The filamentous hose or tube has preferably an external diameter which substantially corresponds to the internal diameter of the steel tube. The filamentous hose should be flexible and have a resistance to the effect of heat exceeding the maximum temperature which the hose is intended to be exposed to. Further, the hose should not be waterproof.

Since the hose is not watertight the cooling liquid which is circulated through the cooling system will flow axially through the hose. In addition there will be a radial flow through the wall(s) of the hose, filling up any voids or volumes between the hose and the enclosing pipe wall. In addition the cooling liquid will fill in the voids or pores appearing in the wall(s) of the texture. When circulating through the cooling system, the coolant, which normally is water, is given a predetermined, adjusted speed through the pipes. Due to friction/adhesion with the wall(s) of the pipes and the porous texture wall the axial velocity of the coolant will be at its maximum along the centre of the tube and decrease towards the periphery of the tube. According to the present invention where a permeabe hose of flexible texture is introduced into the interior of the tube(s), the axial velocity of the coolant through the tube(s) will approximately be zero along the texture. Further, there will be substantially no radial transport of coolant through the texture wall(s) towards the wall(s) of the tube(s). Hence, according to the present invention a more or less stationary boundary layer along the periphery of tube is created. The passage of the coolant radially outwards to and through the hose texture depends on several factors such as the permeability of the texture, the porousity and the thickness of the texture.

By external heating a tube incorporating an internal texture hose, the temperature of the tube will increase more rapidly than that of a tube without such internal texture hose, if exposed to the same amount of heat and the same amount and velocity of the coolant through the tubes. For the latter type, i.e. a tube without an internally arranged texture hose, the temperature of the tube wall will reach a temperature of 100° C. only when the cooling water within the tube boils, producing steam which blocks a further passage of cooling water.

According to the present invention the boundary layer of cooling water has substantially no axial velocity. Hence, the boundary layer of water will relatively fast reach a temperature of 100° C. and be converted to steam. Additional heating will cause an increase in the steam temperature whereby the heat energy externally supplied will be transferred to the coolant through an atmosphere of steam thereby providing an enclosing steam collar around the texture hose. Such enclosing collar will reduce locally the cross sectional of the hose and thereby the cross sectional area of flow of the coolant. In addition a well defined boundary between the two phases, i.e. steam and liquid, is achieved. The reduction of area of flow will locally cause an increased velocity of flow, providing a temporarily increased capacity of heat transport. Further, the wetted surface of the tube is increased compared to a tube without an internally arranged hose. Thus, because of the hose a two-phase flow in the tube is made possible without necessarily causing blockage of the tube.

When the steam collar subsequently has disappeared, the hose will regain its original shape. Thus, according to the present invention, it is imperative that the hose is flexible and compliant.

As previously stated the hose is made of a texture of textile or similar material, the hose and the texture being flexible. It should be appreciated that the hose may be made of any suitable material having the required flexibility, permeability and/or porousity, wall thickness and heat resistance. Alternatively, the hose may be formed as a continuous layer on the internal walls of the tube(s).

The hose is preferably introduced into those parts of the cooling system where temperature regulation and control is required. The hose may for example be fastened to the inlet end of each tube. The hose may further be inserted in any conventional manner, and the hose may be fastened to the tube for example by means of for example a connecting tube or plug.

What is claimed is:

1. In the process of cooling members by passing a coolant liquid through one or more conduits attached to the members, wherein the temperature of the members can cause at least a portion of the coolant liquid to vaporize, the improvement comprising the steps of placing in said one or more conduit a flexible hose, which is permeable to said coolant liquid, said flexible hose setting up a boundary layer in said conduit, vaporizing liquid coolant between the outside wall of the hose and the inside wall of the conduit, contracting the flexible hose due to the vapor formation thereby providing an enclosing vapor collar around said hose, increasing the axial velocity of the liquid coolant flow by the contraction of the permeable hose whereby additional heat externally supplied will be transferred to the coolant through an atmosphere of vapor.

2. The method of claim 1 wherein said hose is a flexible fiberglass hose and the selected coolant liquid is water.

* * * * *